US011986093B2

(12) United States Patent
Yang

(10) Patent No.: US 11,986,093 B2
(45) Date of Patent: May 21, 2024

(54) SHELF HOLDING STRUCTURE HAVING ATTACHABLE AND DETACHABLE POWER SUPPLY

(71) Applicant: Yunsun Yang, Seoul (KR)

(72) Inventor: Yunsun Yang, Seoul (KR)

( * ) Notice: Subject to any disclaimer, the term of this patent is extended or adjusted under 35 U.S.C. 154(b) by 157 days.

(21) Appl. No.: 17/630,047

(22) PCT Filed: Jul. 8, 2020

(86) PCT No.: PCT/KR2020/008904
§ 371 (c)(1),
(2) Date: Jan. 25, 2022

(87) PCT Pub. No.: WO2021/025303
PCT Pub. Date: Feb. 11, 2021

(65) Prior Publication Data

US 2022/0273099 A1 Sep. 1, 2022

(30) Foreign Application Priority Data

Aug. 6, 2019 (KR) ..... 10-2019-0095730

(51) Int. Cl.
*A47B 96/02* (2006.01)
*A47B 57/42* (2006.01)
(Continued)

(52) U.S. Cl.
CPC ..... *A47B 96/067* (2013.01); *A47B 57/42* (2013.01); *A47B 2097/003* (2013.01); *A47B 2220/0077* (2013.01)

(58) Field of Classification Search
CPC ..... A47B 96/067; A47B 96/06; A47B 96/063; A47B 57/42; A47B 2097/003; A47B 2220/0077; A47B 96/02; A47B 96/00
(Continued)

(56) References Cited

U.S. PATENT DOCUMENTS 3,909,502 A * 9/1975 Lacan ..... H02G 3/0493 52/220.2
5,690,415 A * 11/1997 Krehl ..... F21S 8/00 362/370
(Continued)

FOREIGN PATENT DOCUMENTS

JP 2002165679 A 6/2002
JP 2004081521 A 3/2004
(Continued)

OTHER PUBLICATIONS

International Search report of PCT/KR2020/008904, dated Oct. 13, 2020, English translation.

*Primary Examiner* — Nkeisha Smith
(74) *Attorney, Agent, or Firm* — STIP Law Group, LLC

(57) ABSTRACT

The purpose of a shelf holding structure having an attachable and detachable power supply according to the present invention is to provide a shelf holding structure to which power is supplied, wherein the shelf holding structure has a very pleasing aesthetical appearance because a shelf power supply device is not exposed to the outside, simple and expandable construction of the power supply is possible to suit varying on-site circumstances, and the power supply device can be easily detached and attached.

5 Claims, 5 Drawing Sheets

(51) Int. Cl.
*A47B 96/06* (2006.01)
*A47B 97/00* (2006.01)

(58) Field of Classification Search
USPC ..... 248/250
See application file for complete search history.

(56) References Cited

U.S. PATENT DOCUMENTS

| | | | | |
|---|---|---|---|---|
| 6,296,498 | B1 * | 10/2001 | Ross | H01R 25/145 439/115 |
| 7,256,346 | B2 * | 8/2007 | Walter | H01R 25/14 52/36.6 |
| 7,405,357 | B2 * | 7/2008 | Laurosch | A47B 47/027 174/72 B |
| 9,098,823 | B2 * | 8/2015 | Slesinger | H01R 25/142 |
| 10,184,622 | B2 * | 1/2019 | Dong | F21V 23/023 |
| 10,274,187 | B2 * | 4/2019 | Zhong | A47B 97/00 |
| 2005/0082239 | A1 * | 4/2005 | Laurosch | H02B 1/20 312/265.4 |
| 2008/0043456 | A1 * | 2/2008 | Bernardini | F25D 25/02 362/125 |
| 2011/0215212 | A1 * | 9/2011 | Keyvanloo | A47B 96/1466 248/220.22 |
| 2018/0283668 | A1 * | 10/2018 | Conrady | A47B 77/08 |
| 2022/0173557 | A1 * | 6/2022 | Xue | A47F 5/0853 |
| 2022/0360066 | A1 * | 11/2022 | Balaun | A47F 5/103 |

FOREIGN PATENT DOCUMENTS

| | | | |
|---|---|---|---|
| KR | 101052472 | B1 | 7/2011 |
| KR | 101052473 | B1 | 7/2011 |

* cited by examiner (a)

(b)

SHELF HOLDING STRUCTURE HAVING ATTACHABLE AND DETACHABLE POWER SUPPLY

CROSS-REFERENCE TO RELATED APPLICATIONS

This application is the U.S. National Phase under 35 U.S.C. § 371 of International Application No. PCT/KR2020/008904 filed on Jul. 8, 2020, which in turn claims the benefit of Korean Application No. 10-2019-0095730 filed on Aug. 6, 2019, the disclosures of which are incorporated by reference into the present application.

TECHNICAL FIELD

The present disclosure relates to a shelf holding structure having an attachable and detachable power supply, and relates to a shelf holder which has a very pleasing aesthetical appearance since a device for supplying power to the shelf holder is not exposed to the outside, which is capable of supplying power through a simple and changeable process suiting on-site circumstances, and which is capable of operating a power supply facility with expandability since a power supply device is attachably and detachably configured.

More specifically, the present disclosure relates to a shelf holding structure having an attachable and detachable power supply, wherein a track having a conductor embedded therein is provided in a holder, and a power supply is attached to one end or the other end of the track to supply power, and, when a connector for supplying power to a shelf is inserted into a certain position of a connector insertion portion of the shelf holder, a power source is connected and supplies power to lighting on the shelf, wherein the track is attachable to and detachable from the holder and can selectively apply the power supply device when necessary after the holder is installed, wherein the aesthetical appearance of the shelf holding structure can be enhanced since the power supply device is less exposed to the outside, and an installation method of the shelf holding structure is so simple that the shelf holding structure can be easily applied to an already installed shelf holder.

BACKGROUND ART

For shelves used for exhibiting and displaying various products or works, lighting, etc. is increasingly used to enhance a visual exhibition effect in addition to a simple exhibition, displaying function, and shelves to which electricity is supplied are being provided.

The most simple and common method to supply electricity to a shelf is connecting a power cable to the shelf from a socket, but this method may not provide a pleasing aesthetical appearance and may have a problem that extra labor and device for drawing electricity should be additionally provided.

In particular, when power supply is needed after on-site equipment is finished, an existing facility should be disassembled and reconstruction should be performed, and according to circumstances, there may be a problem that it is impossible to supply power due to a position problem with a power supply facility.

Accordingly, a method of embedding an electric wire in a shelf holder positioned on a side surface of a shelf and inserting a plug into a desired position and connecting electricity for use is being recently adopted.

However, in the case of a shelf holder having an electric wire embedded therein in the existing method, a regular conducting device may be uniformly embedded without considering that an on-site condition such as a position of a power supply may be different, and in the field, a distance or a position to a power cable may not be appropriate, so that it is difficult to use the power supply, or the power supply may be provided on an unnecessary position, and thus a cost may increase and the power supply may be useless.

In addition, when a method of inserting a conductor into a holder is employed, it may be difficult to install an electricity facility simultaneously when a shelf is installed in the field, and accordingly, a shelf having a conductor embedded therein may be produced in a factory. In this case, however, it may be difficult to apply a variable construction method according to on-site circumstances, and the shelf may not efficiently be used.

In addition, after installation of electricity equipment in a shelf structure is completed, it is impossible to remove the embedded electricity equipment even when it is necessary to shut off power supply afterwards, or, even if it is possible, the method to remove is very difficult to perform and there may be a problem that much time, labor, and cost are required.

PRIOR ART DOCUMENT

Patent Document (Patent Document 1) Korean Patent Registration No. 10-1052473

DETAILED DESCRIPTION OF THE PRESENT DISCLOSURE

Technical Objects

The present disclosure has been developed in order to solve the above-mentioned problems, and an object of the present disclosure is to provide a shelf holding structure having an attachable and detachable power supply, wherein a track formed in a rail shape having an upper portion opened and having a conductor provided on an inner side surface thereof is mounted in a shelf holder which is held by a hook on a side surface of a shelf to support the shelf, a power supply is connected to one end and the other end of the track to supply power to the conductor of the track, and a track connector for supplying electricity to the shelf is inserted through a certain space between rods of the shelf holder to connect to the track and to conduct electricity of the power supply to provide electricity to the shelf, wherein the track is easily attached to and detached from the inside of the shelf holder in a simple method, so that power supply to a shelf requiring power supply is possible in the field by a simple operation, and a pleasing aesthetical appearance can be provided since a cable is not exposed to the outside lengthways, and an installation method of the shelf holding structure is so simple that the shelf holding structure can be easily applied to an already installed shelf holder.

The above-described object of the present disclosure and various advantages will be more apparent to those skilled in the art based on preferred embodiments of the present disclosure.

Technical Solving Method

The present disclosure has been developed to achieve the above-described object, and according to an embodiment of the present disclosure, a shelf holding structure having an attachable and detachable power supply includes: a track formed in a ⊏-shaped rail shape having an upper portion opened; a shelf holder comprising a track receiving space formed therein in a shape corresponding to the track, and having rods installed across an opened upper portion at predetermined intervals to hold a shelf; a power supply inserted into one side surface or the other side surface of the track to supply external power; and a track connector inserted into a space between the rods of the shelf holder and mounted in the track to connect power to the shelf, wherein the track has a conductor disposed on an inner side surface thereof along a longitudinal direction, and is attachable to and detachable from an inside of the shelf holder, and the track further comprises heads formed on upper ends of both side surfaces to be bent inward by a predetermined length.

According to an embodiment, the shelf holder may further include: a track receiver to allow the track to contact inner side surfaces and a lower surface thereof and to form a space to receive the track; protrusions protruding from both side surfaces of the inside at a predetermined height along a longitudinal direction, and having a lower portion contact the head of the track; and connector insertion portions formed between the rods to form a space through which the connector is inserted, the track connector may include: a connector body formed on one end thereof in a hexahedral shape to be inserted and mounted in the track; and a shelf cable formed on the other end thereof to connect a current of the track to the shelf, and the power supply may include: a power body formed on one end thereof in a shape to be received in the track and inserted into the track; and a power cable formed on the other end to receive power.

According to an embodiment, the connector body may further include: a connector electrode provided on a side surface contacting the track to come into contact with the conductor and to conduct electricity; and a plurality of connector protrusions formed in a shape to be engaged with the heads.

According to an embodiment, the power body may include: a power head formed on one side thereof to be inserted and received in the track; and a power tail formed on the other side thereof larger than the power head to be supported in contact with an outer surface of the track, and the power head may further include a plurality of power electrodes formed on a side surface thereof contacting the conductor; and one pair of head recesses provided on both edges of an upper end in a recess shape corresponding to the head.

According to an embodiment, the shelf holding structure may further include a frame formed in a hexahedral shape and comprising a plurality of holder receivers formed in a shape to receive the shelf holder, and the frame may further include: an elastic fixing portion protruding from a portion to which an upper end of the shelf holder is coupled to support; a screw coupling portion coupled by a screw adjacent to the elastic fixing portion to fix the shelf holder; and a hollow portion formed on an inner surface as an empty space.

Specific matters of other embodiments are included in the detailed descriptions and the drawings.

Advantageous Effect

According to the shelf holding structure having the attachable and detachable power supply of the present disclosure, the following effects may be obtained.

First, when power is supplied to a shelf, an aesthetical appearance which may be degraded due a cable exposed to the outside or extended longways may not be degraded and a simple and clean interior decoration may be configured.

Second, when power is supplied to a shelf in the field for installing the shelf, electricity may be easily conducted by using the track having the conductor embedded therein regardless of various and special on-site variables, and a work process may be simplified, labor may be reduced, and a cost may be reduced.

Third, since conducting is performed through the conductor embedded deep inside the track, a conducting facility is not exposed to the outside and a problem caused by a short circuit may be noticeably reduced and safety may be guaranteed.

Fourth, since the track having the conductor embedded therein is configured in the shelf holder, a power supply facility may be provided without being seen from the outside, and an interior decoration effect of a work or a product displayed on the shelf increases.

Fifth, the track having the conductor embedded therein is easily attached to and detached from the shelf holder, and the track may be mounted when electricity supply is needed, and the track may be easily removed when electricity supply is not needed, and accordingly, the shelf may be utilized for various purposes by using electricity.

Sixth, a separate frame capable of receiving a plurality of shelf holders having tracks embedded therein is configured, and may supply power to a shelf as an independent column structure as well as a wall buried structure, and expandability is high when an interior decoration for exhibiting and displaying is configured.

BEST MODE FOR EMBODYING THE INVENTION

Figure 1:
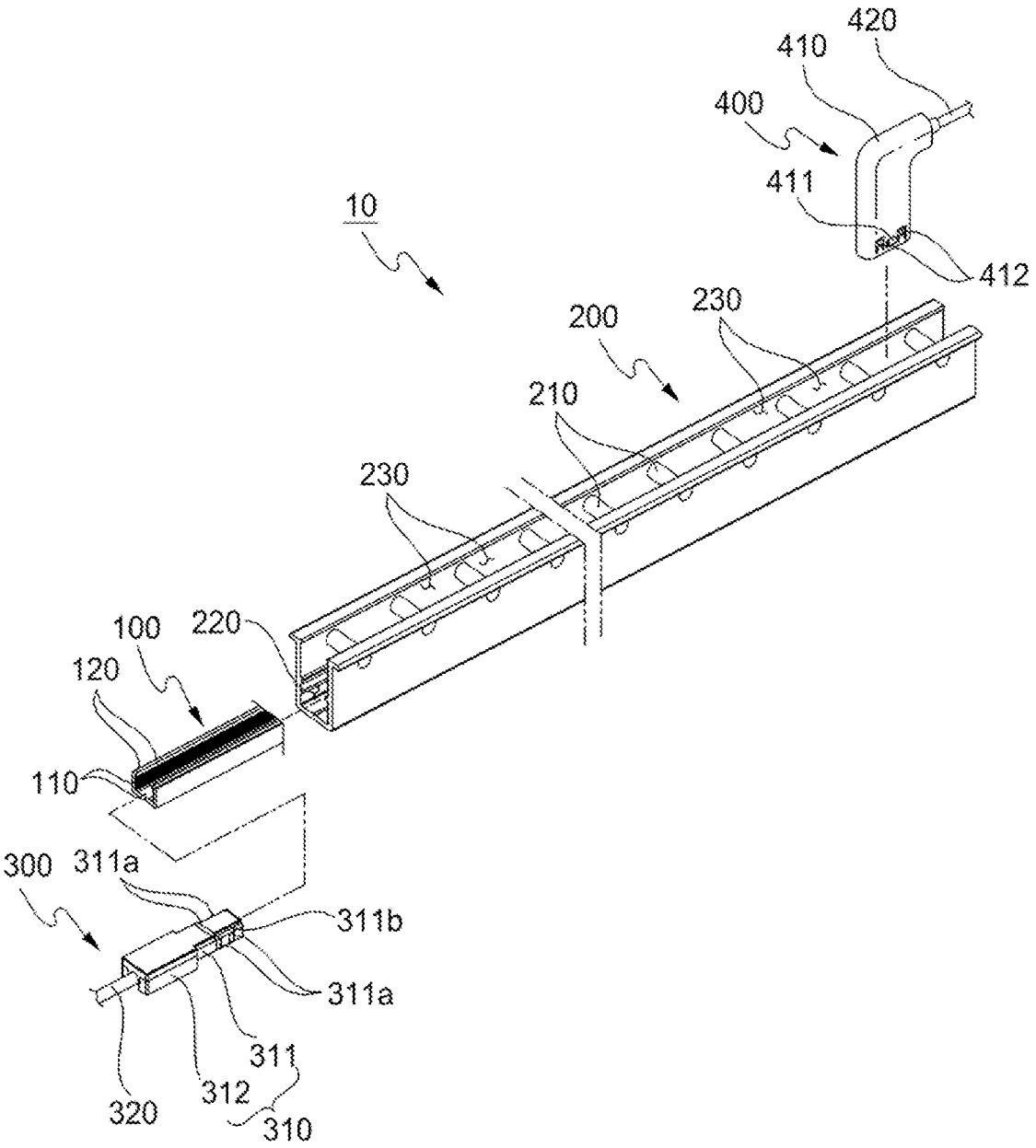
FIG. 1 is a perspective view of a shelf holding structure having an attachable and detachable power supply according to an embodiment of the present disclosure.

Hereinafter, preferred embodiments of the present disclosure will be described in detail with reference to the accompanying drawings for fully understanding of the present disclosure.

Prior to describing the present disclosure, a specific structure or functions presented below are merely illustrated for the purpose of describing embodiments according to the concept of the present disclosure, and embodiments according to the concept of the present disclosure may be implemented in various forms and should not be interpreted as being limited to embodiments described in detail in the present specification.

In addition, various changes can be made to embodiments according to the concept of the present disclosure, and embodiments may have various forms, and thus specific embodiments are illustrated in the drawings and described in detail in the specification.

However, embodiments according to the concept of the present disclosure are not limited to a specific disclosure form and should be interpreted as including various changes, equivalents, or replacements included in the idea and technical range of the present disclosure.

The present embodiments are provided so that the disclosure will be described more thoroughly and completely for an ordinary person in the related art. Accordingly, shapes, etc. of elements on the drawings may be exaggerated in expression to highlight descriptions thereof more clearly.

It should be noted that the same reference numerals are used for the same components in the drawings. Detailed descriptions of well-known functions or configurations will be omitted since they would unnecessarily obscure the subject matters of the present disclosure.

Figure 2:
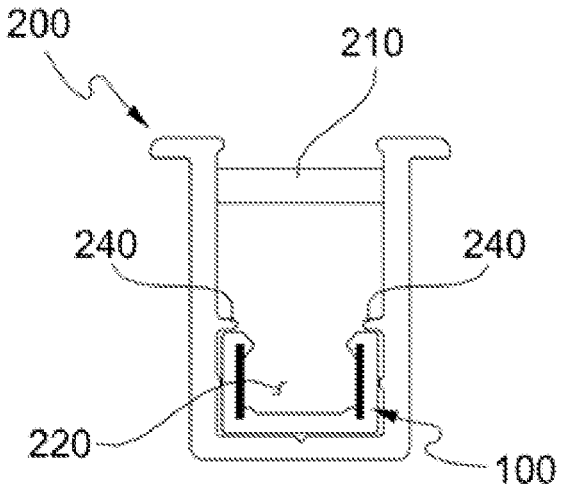
FIG. 2(*a*) and FIG. 2(*b*) are a view illustrating a shelf holder of the shelf holding structure having the attachable and detachable power supply according to an embodiment of the present disclosure.
Figure 2:
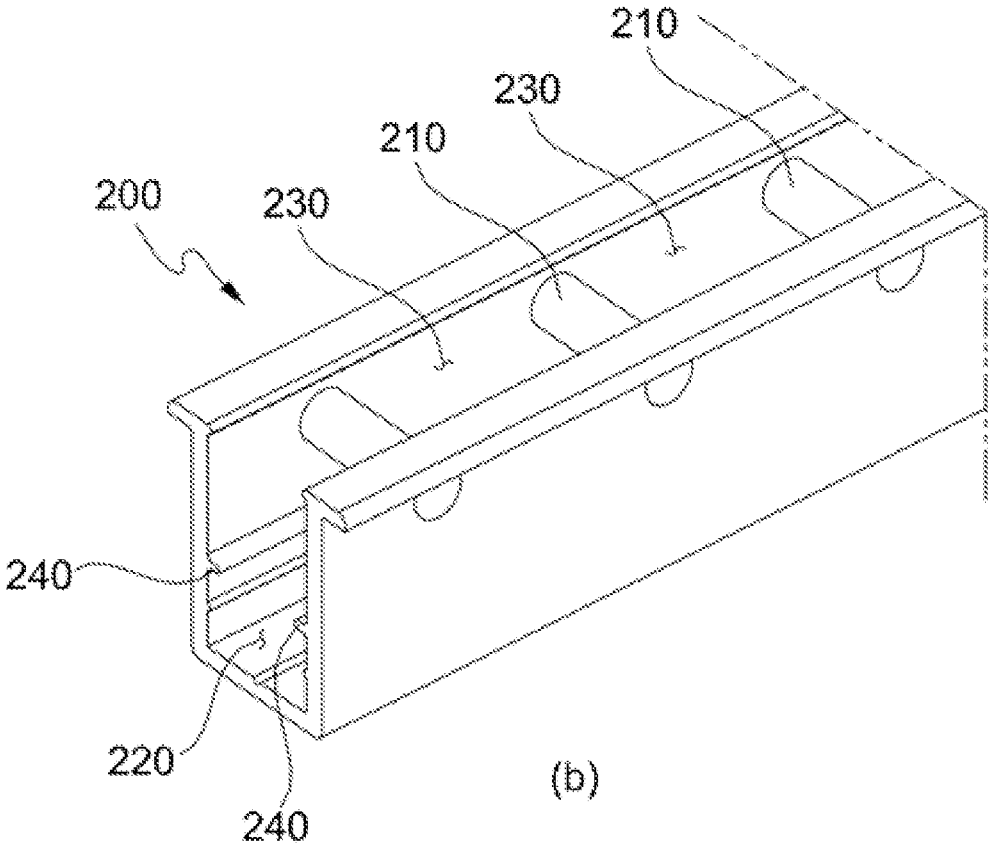
Figure 3:
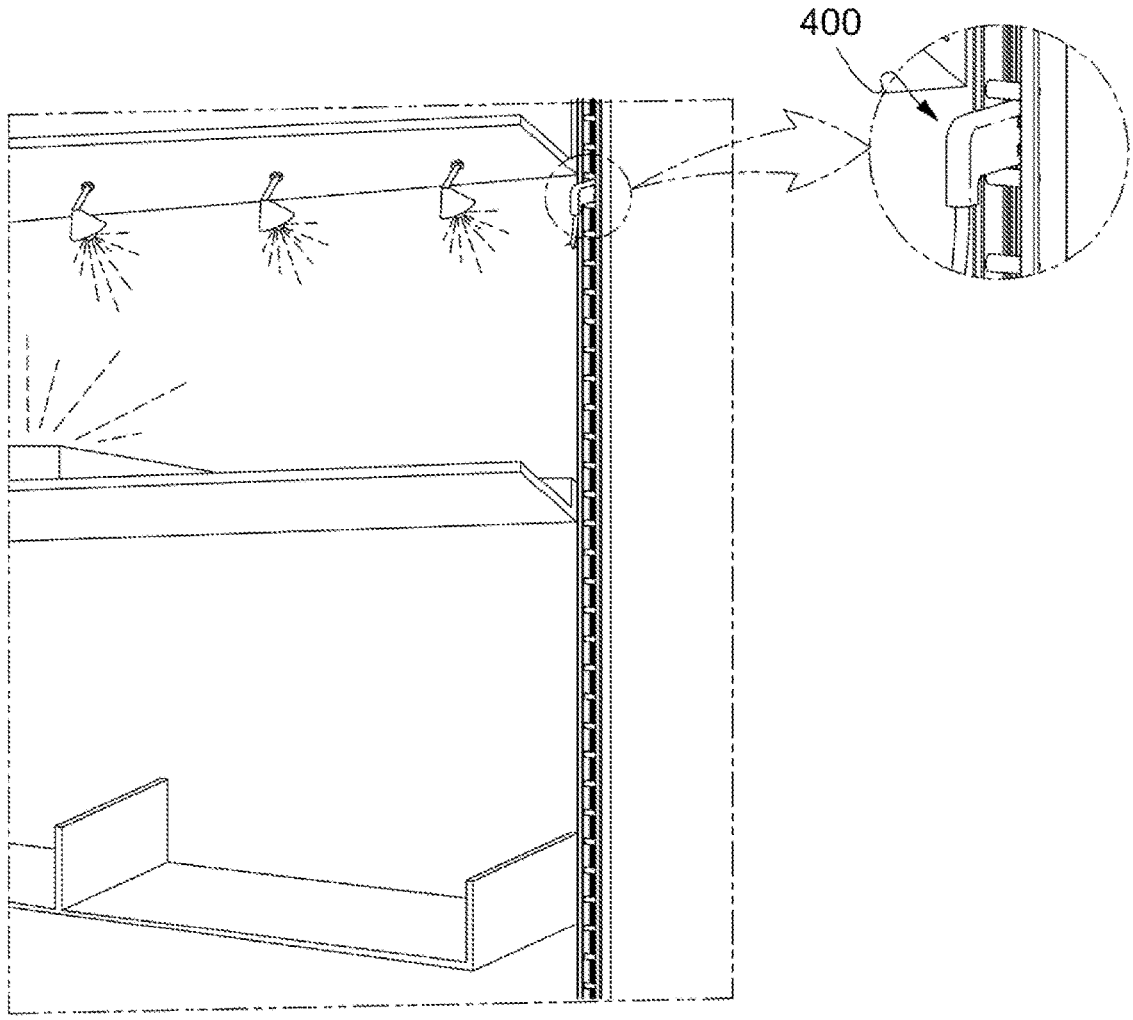
FIG. 3 is a view illustrating an example of the shelf holding structure having the attachable and detachable power supply according to an embodiment of the present disclosure.

FIG. 1 is a perspective view of a shelf holding structure having an attachable and detachable power supply according to an embodiment of the present disclosure, FIG. 2 is a view illustrating a shelf holding of the shelf holding structure having the attachable and detachable power supply according to an embodiment of the present disclosure, and FIG. 3 is a view illustrating an example of the shelf holding structure having the attachable and detachable power supply according to an embodiment of the present disclosure.

The shelf holding structure 10 having the attachable and detachable power supply according to an embodiment of the present disclosure includes a track 100 having an electric conductor provided therein to carry electricity, a shelf holder 200 which accommodates the track 100 and is held by a hook of a shelf to support the shelf, a power supply 300 which supplies external power to the track 100, and a track connector 400 which connects power of the track 100 to an electronic device such as a lighting member of the shelf, etc.

According to an embodiment of the shelf holding structure 10 having the attachable and detachable power supply of the present disclosure, the track 100 may be formed in a '⊏'-shaped rail shape to have an upper portion opened.

The track 100 may be formed to have a shape and a length to be accommodated in the shelf holder 200, which will be described below.

The track 100 may include a conductor 110 provided on both surfaces of the inside of the track 100 along a longitudinal direction, and the conductor 110 may function to connect electricity between an external power source and the shelf.

Heads 120 formed on upper ends of both side surfaces of the track 100 may be formed to be bent toward the inside of the track 100 by a predetermined length.

The head 120 of the track 100 may be formed to face the inside of the track 100 and simultaneously to be bent downward.

The conductor 110 may be formed on an inner surface of the track 100 and may have a lower portion formed from a corner of the inner bottom surface of the track and an upper portion formed to an inside area of the bent portion of the head 120.

That is, the conductor 110 may have the upper portion enclosed and fixed by the head 120, so that the conductor 110 is stably attached without being released from the inner surface of the track 100.

A plurality of conductors 110 may be formed on inner surfaces of both sides of the track 100, and likewise, a plurality of heads 120 may also be formed on upper ends of both side surfaces of the track 100.

The conductor 110 may serve to receive external power and connect electricity to an electronic device such as a lighting element of the shelf, and the track 100 may serve as a passage to conduct electricity through the conductor 110.

The conductor 110 includes one side surface of the inside thereof connected to an anode and the other side surface of the inside connected to a cathode.

The conductor 110 may be positioned deep into the track 100 and may be enclosed by the head 120, so that the conductor 110 is not exposed to the outside.

Accordingly, when the conductor 110 is configured in the shelf holding structure 10 having the attachable and detachable power supply of the present disclosure, a short circuit is less problematic and the shelf holding structure may be safely used.

According to an embodiment of the shelf holding structure 10 having the attachable and detachable power supply of the present disclosure, the shelf holder 200 may include a rod 210, a track receiver 220, a connector insertion portion 230, and a protrusion 240.

The shelf holder 200 may be held by a hook of a shelf to support the shelf, and may be configured to serve to receive the track 100.

That is, the shelf holder 200 may be provided on a side surface of a panel installed on a wall, and may be hooked by a side surface hook installed on a front surface of the panel to support the shelf.

In addition, the shelf holder 200 may include the track receiver 220 which is formed in a shape corresponding to the track 100 and is formed larger than the track 100, and is formed to have a receiving space for the track 100.

The track receiver 220 is a space that is formed inside the shelf holder 200 to receive the track 100, and is formed in a shape enclosing the track 100 in engagement therewith while contacting the track 100 on inner side surfaces and a lower surface of the shelf holder 200.

The rods 210 may be installed on the opened upper portion of the shelf holder 200 at predetermined intervals to be held by the side surface hook of the shelf described above.

A space formed between the rods 210 of the shelf holder 200 is the connector insertion portion 230 through which the track connector 400 is inserted, and provides a passage to allow the track connector 400 to be coupled with the track 100 mounted in the shelf holder 200 from the outside of the shelf holder 200.

The protrusions 240 may be formed on both inner surfaces of the shelf holder 200 and may protrude to a predetermined height along a longitudinal direction.

The protrusions 240 may be formed to come into contact with the heads 120 of the track 100 and may be formed in a shape similar or corresponding to the heads 120.

When the track 100 is inserted into the shelf holder 200, the track may be mounted in a space under the protrusions 240, and the protrusions 240 may be coupled with the heads 120 of the track 100 by pushing downward the heads 120 in contact therewith.

The track 100 may be inserted from an end of the shelf holder 200 toward the track receiver 220 on a side surface of the shelf holder 200 and may be mounted in alignment with lower ends of the protrusions 240.

In addition, the track 100 may be obliquely inserted into a space between the rod 210 and the protrusions 240 toward the track receiver 220 on a side surface of the shelf holder 200 in its entirety, and then, the head 120 on one end is pushed toward the lower end of the protrusion 240, first, and then, while changing the direction to be horizontal, a portion of the head 120 on the other end is pushed to be coupled with the lower end of the protrusion 240, such that the track is mounted.

The track 100 may be easily attached to the track receiver 220 of the shelf holder 200 in the above-described method, and on the other hand, the track may be easily detached through application of the above-described method.

Accordingly, when supply of electricity is needed when a shelf is installed in the field, the track 100 may be pushed in and mounted in the shelf holder 200 for use, and to the contrary, when supply of electricity is not needed, the already installed track 100 may be removed from the shelf holder 200 and may be used.

Accordingly, a wiring operation for electricity supply is not required when the shelf holding structure is pre-produced in a factory, and unnecessary equipment, labor, cost may be reduced.

The power supply 300 is inserted through a side surface of one end or the other end of the track 100 to function to supply external power.

The power supply 300 may include a power body 310 and a power cable 320 according to an embodiment of the present disclosure.

In addition, the power body 310 may include a power head 311 and a power tail 312, and the power head 311 may include a power electrode 311*a*, a head recess 311*b*.

The power body 310 may be formed on one end of the power supply 300 in a shape to be inserted into the track 100 and to be received in the track 100, and the power cable 320 may be formed on the other end of the power supply 300 to be connected with an external power source and to receive external power.

The power body 310 may be formed in a hexahedral shape, but may have a stepped structure having different widths and heights on one side and the other side.

That is, one side of the power body 310 is the power head 311 and is formed in a shape to be press-fitted into the track 100, and the other side is the power tail 312 and is formed to have a larger width than the power head 311.

When the shape of the power body 310 being inserted into the track 100 is measured above with the eye, the power head 311 is viewed as an upper end and the power tail 312 is viewed as a lower end, and the power cable 320 is viewed as being connected in a backward direction of the power tail 312.

The power head 311 is inserted into the track 100 and the power tail 312 is positioned over an outside of the track 100.

That is, the power body 310 may have such a shape that the power body is in contact with the inside of the track 100 as long as the power head 311, and is exposed to the outside of the track 100 as long as the power tail 312.

The power head 311 may include a plurality of power electrodes 311*a* formed on both side surfaces thereof.

When the power head 311 is inserted into the track 100, the plurality of power electrodes 311*a* come into contact with the conductor 110 of the track 100 and maintain an electric coupling state, and accordingly, external power may be supplied to the track 100 through the power body 310 along the power cable 310.

The power electrodes 311*a* may be divided into an anode and a cathode on one side surface and the other side surface, respectively, to form an electrode.

The plurality of power electrodes 311*a* may be formed on both side surfaces, thereby increasing contact points with the conductor 110 and thus preventing a problem in electricity supply due to a contact failure.

The power head 311 may include one pair of head recesses 311*b* formed on both edges of the upper end thereof in a recess shape to be smoothly coupled with the track 100.

The head recess 311*b* may be formed in a shape corresponding to the head 120 f the track 100, and may perform not only a function of enhancing a coupling force with the track 100 but also a function of fixing not to easily decouple.

The power supply 300 may be smoothly coupled with the track 100 through the head recesses 311*b*, and may maintain a stable coupling state.

The track connector 400 may perform a conducting function to connect power supplied to the track 100 to an electronic device such as a lighting member, etc. of the shelf.

The track connector 400 is mounted in the track 100 received in the shelf holder 200 from the outside of the shelf holder 200 through the connector insertion portion 230 of the shelf holder 200.

The track connector 400 may be inserted through a connector insertion portion 230 that is selected from the plurality of connector insertion portions 230 formed on the shelf holder 200 and that is closest to the shelf to connect and is positioned on a good position in view of an aesthetical appearance.

Even when the track connector 400 is coupled with the track 100 through a certain connector insertion portion 230, the track 100 may smoothly conduct electricity since the conductor 110 is formed on the inner side surface of the track 100 over the entire area of the track 100 along the longitudinal direction.

The track connector 400 may include a connector body 410 and a shelf cable 420, and the connector body 410 may include a connector protrusion 412 and a connector electrode 411.

The connector body 410 may be formed on one end of the track connector 400 and may have a front surface formed in a rectangular parallelepiped shape to be inserted into and mounted in the track 100, and may have a rear surface bent in a vertical direction.

The shelf cable 420 may be formed on the other end of the track connector 400 and may serve as a power cable connected to the bent rear surface of the connector body 410, and may be connected to the electronic device of the shelf.

When the track connector 400 is coupled to the track 100, external power supplied through the power supply 300 flows along the conductor 110 of the track 100 and conducts electricity to the shelf cable 420 through the connector body 410, thereby providing electricity to the electronic device of the shelf.

To achieve this, the connector body 410 may include the connector electrodes 411 formed on portions of both side surfaces thereof that contact the track 100 to conduct electricity.

In this case, in order to smoothly and stably supply electricity, the connector body 410 may include a plurality of connector protrusions 412 formed on both side surfaces of the connector body 410 in a protrusion shape and having elasticity to prevent the connector body 410 from being easily detached from the track 100.

Due to the presence of the connector protrusions 412, the connector body 410 is not easily detached after being coupled and inserted into the track 100, and maintains a stable coupling state, thereby maintaining a smooth conducting state.

A use example of the shelf holding structure 10 having the attachable and detachable power supply according to an embodiment of the present disclosure will be described based on the above description.

The shelf holder 200 may be provided on a side surface of a panel installed on a wall surface, and a side surface hook of a shelf installed on the front surface of the panel may be mounted on a certain rod 210 of the shelf holder 200 and may support the shelf.

From the plurality of shelf holders 200 installed, a shelf holder 200 buried on a portion to be connected to an electronic device such as a lighting member on the shelf by supplying electricity is selected.

The track 100 is inserted and mounted in the track receiver 220 formed on a side surface of the shelf holder 200.

In this case, the track 100 may be mounted by being made to face the track receiver 220 and inserting and pushing the heads 120 of the track 100 from an end of the shelf holder 200 in alignment with the lower ends of the protrusions 240.

In another method, the track 100 may be made to face the track receiver 220 and may be obliquely inserted into the space between the rod 210 and the protrusion 240 in its entirety, and then, the head 120 on one end may be pushed and aligned with the lower end of the protrusion 240 first, and then, while changing the direction to be horizontal, the head 120 on the other end is pushed and coupled with the lower end of the protrusion 240, such that the track is mounted.

Accordingly, the heads 120 of the track 100 come into contact with the lower ends of the protrusions 240 of the track receiver 220, and the track 100 is coupled with the shelf holder 200 while maintaining a stable and fixed state.

Next, the power supply 300 is inserted into the track 100 to supply electricity to the track 100.

The power cable 320 of the power supply 300 is connected to a neighboring external power source to use, and the power body 310 is inserted and coupled with the track 100.

The power head 311 of the power body 310 is smoothly coupled as the head recess 311*b* is press-fitted over the head 120 of the track 100, and the power body 310 is supported in contact with the outside of the track 100 by the power tail 312, and is prevented from being inserted into the track 100.

The plurality of power electrodes 311*a* formed on both side surfaces of the power head 311 as an anode and a cathode come into contact with an anode and a cathode of the conductor 110 which is embedded in the inner surface of the track 100 along the longitudinal direction, thereby providing electricity.

In this case, the head recess 311*b* of the power supply 300 is strongly engaged with the head 120 of the track 100, thereby maintaining the fixed state and preventing the power supply 300 from being easily released from the track 100 and preventing power supply from being shut off.

Next, the track connector 400 connected to the shelf which operates an electronic device such as a lighting member, etc. by supplying electricity is connected with the track 100.

To achieve this, a connector insertion portion 230 that is closest and has a pleasing aesthetical appearance is selected from the connector insertion portions 230 formed between the rods 210 of the shelf holder 200, and the connector body 410 of the track connector 400 is inserted thereinto.

The connector body 410 is coupled to the track 100 mounted in the shelf holder 200, and the connector electrodes 411 provided on both side surfaces of the connector body 410 come into contact with the conductor 110 of the track 100, thereby conducting electricity.

In this case, the plurality of connector protrusions 412 having elasticity are formed on both side surfaces of the connector body 410 to prevent the connector body 410 and the track 100 from being detached from each other and to stably maintain a mutually coupled state therebetween.

Electricity connected to the connector body 410 is supplied to the electronic device of the shelf through the shelf cable 420.

In this case, an on/off switch may be disposed on a portion of the track connector 400 or a portion of the electronic device of the shelf to adjust flow of conducted electricity when necessary.

Electricity is supplied to the electronic device of the shelf, so that a user can utilize the shelf having an electric effect like lighting in a simple method while maintaining a simple appearance.

When power supply is not required in the shelf holder 200 having the track 100 mounted therein, electricity may be shut off by detaching the power supply 300 and the track connector 400.

In addition, the track 100 may be detached from the shelf holder 200 in a simple method in the reverse order of the process of mounting the track 100 in the shelf holder 200.

If the shelf holder 200 having the track 100 mounted therein is released from a factory, the track 100 may be easily detached in a work site or an exhibition through the above-described process.

When a position of the shelf is changed, the track connector 400 is separated from the shelf holder 200 and the track 100, and, after the shelf is fixed to a desired position, the track connector 400 is mounted in a track 100 positioned in a certain adjacent position, so that electricity can be always supplied in the same and simple shape without an additional operation.

Figure 4:
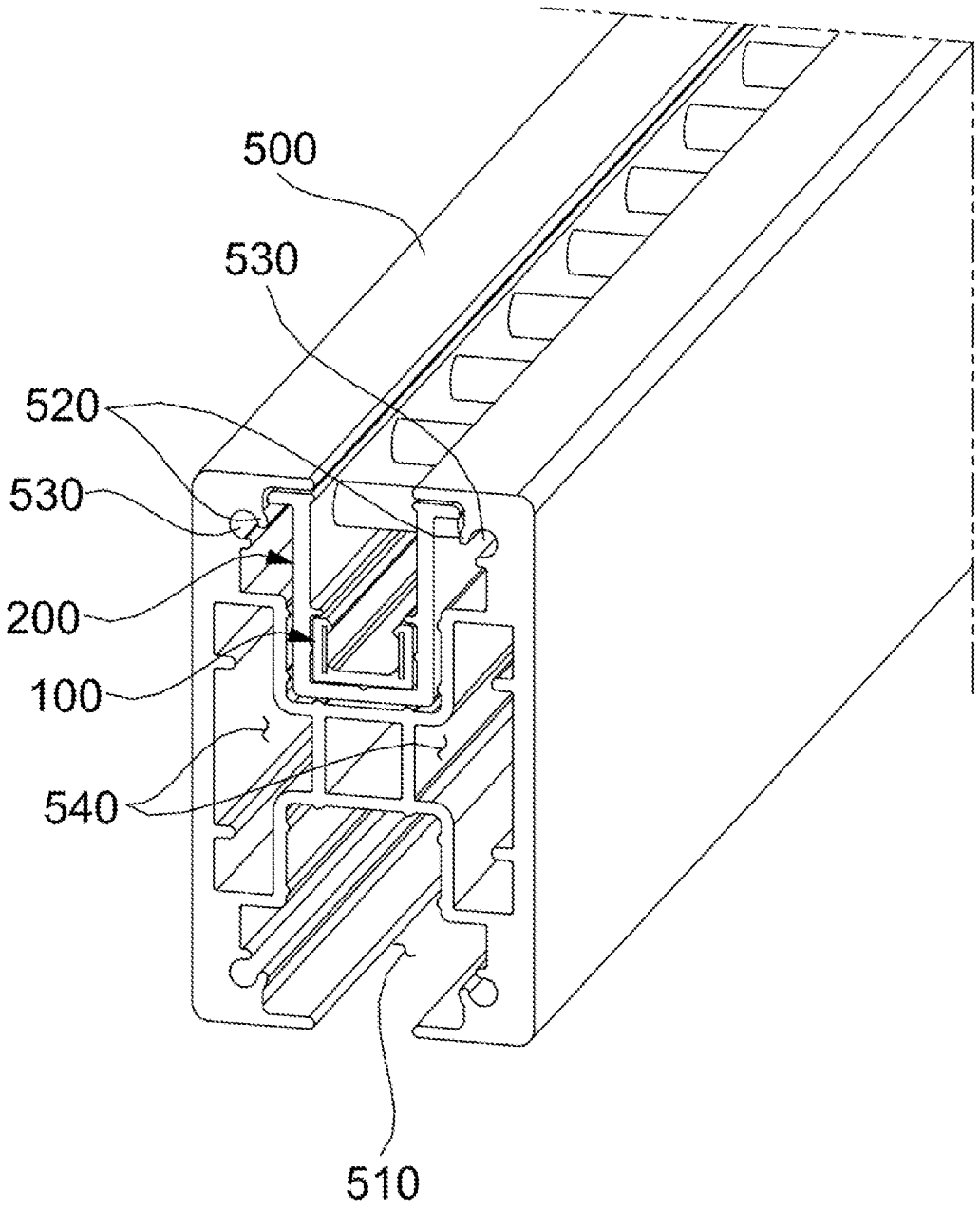
FIG. 4 is a view illustrating a frame of a shelf holding structure having an attachable and detachable power supply according to an additional embodiment of the present disclosure.
Figure 5:
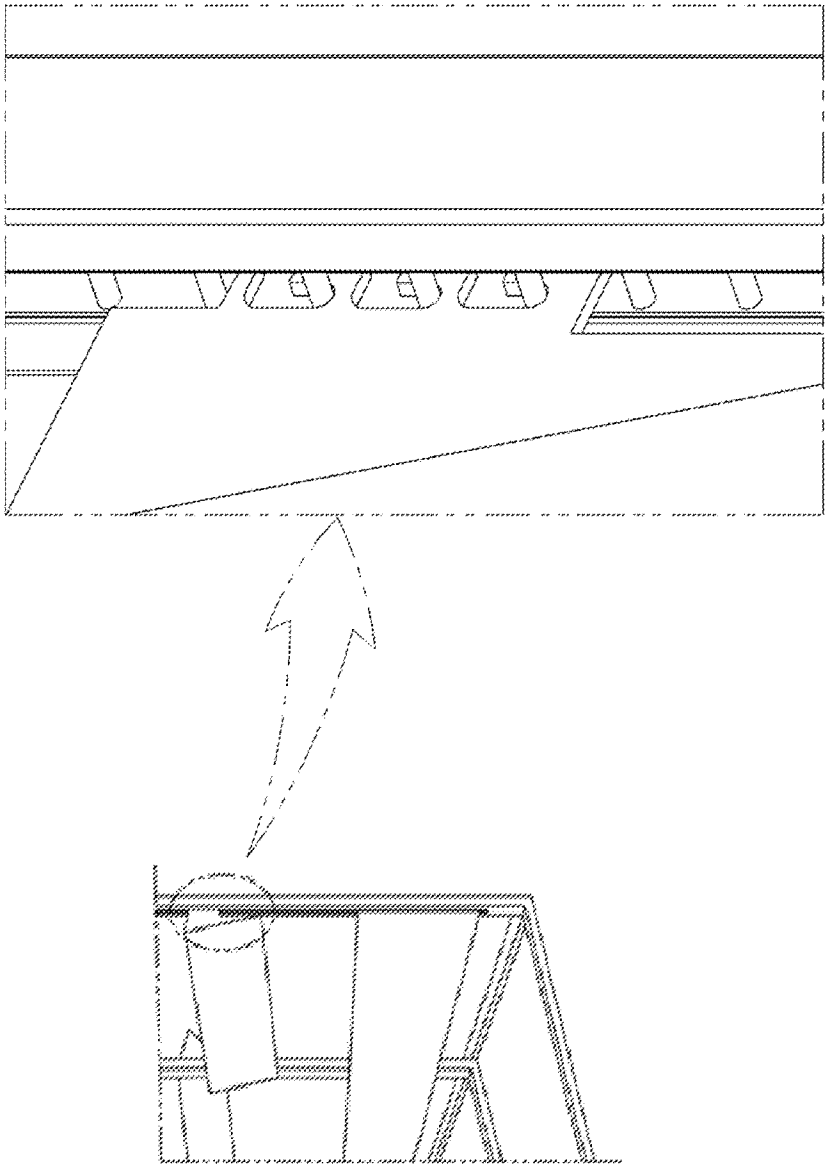
FIG. 5 is a view illustrating an example of the frame of the shelf holding structure having the attachable and detachable power supply according to the additional embodiment of the present disclosure when it is in use.

FIG. 4 is a view illustrating a frame 500 of a shelf holding structure 10 having an attachable and detachable power supply according to an additional embodiment of the present disclosure, and FIG. 5 is a view illustrating an example of the frame 500 of the shelf holding structure 10 having the attachable and detachable power supply according to the additional embodiment of the present disclosure when it is in use.

The shelf holding structure 10 having the attachable and detachable power supply according to the additional embodiment of the present disclosure is the same as the configuration in the embodiment of the present disclosure described above with reference to FIGS. 1 to 3, and there is a difference in that the frame 500 is additionally provided.

Accordingly, the same parts as in the embodiment will not be described and descriptions of the frame 500 which is an additional component will be highlighted.

The shelf holding structure 10 having the attachable and detachable power supply according to the additional embodiment of the present disclosure further includes the frame 500 which is formed in a hexahedral shape and includes a plurality of holder receivers 510 formed therein in a shape to receive the shelf holder 200.

In addition, the frame 500 may further include an elastic fixing portion 520, a screw coupling portion 530, and a hollow portion 540 formed in spaces adjacent to the holder receiver 510.

The holder receiver 510 may be provided in a shape to allow the track receiver 220 of the shelf holder 200 to face the outside on one side surface and the other side surface of the inside of the frame 500.

That is, the track receivers 220 may be formed on one side surface and the other side surface of the frame 500 in the opposite directions to allow the lower closed surfaces of the connector insertion portions 230 to face each other.

Accordingly, the track connectors 400 may be inserted into one side surface and the other side surface of the frame 500 in the opposite directions.

The shelf holder 200 is inserted into the holder receiver 510 and is mounted in the frame 500.

In this case, the plurality of elastic fixing portions 520 formed with a strong material having elasticity are provided so that the shelf holder 200 maintains a strong coupling force in the frame 500 and maintains a fixed state.

The elastic fixing portion 520 may protrude from a portion coupled to an upper end edge of the shelf holder 200.

When the shelf holder 200 is pushed from one end or the other end of the frame 500 toward the side surface and is mounted, the elastic fixing portion 520 may have its protruding portion bent downward by a predetermined angle by the upper end edge of the shelf holder 200.

Accordingly, a strong elastic restoring force that the elastic fixing portion 520 has acts to put up the upper end edge of the shelf holder 200.

Accordingly, the shelf holder 200 may stably maintain the coupling state inside the frame 500 due to the role of the elastic fixing portions 520 of tightly holding on both side surfaces.

In addition, in order to more strengthen the coupling state, the screw coupling portion 530 may further be configured on a side surface adjacent to the elastic fixing portion 520.

The screw coupling portion 530 is formed in a space formed adjacent to the bending direction of the elastic fixing portion 520 to couple a screw The screw coupling portion 530 may be coupled with a screw by pushing the screw which is pushed and bent by the shelf holder 200 in the opposite direction of the bending direction, that is, to the original position.

Accordingly, the upper end edge of the shelf holder 200 and the screw coupling portion 530 are positioned on both side surfaces of the elastic fixing portion 520, respectively, and hold a strong coupling force while maintaining the mutual balance of the force.

The hollow portion 540 may be formed in a space of the inside of the frame 500 except for the plurality of holder receivers 510, the elastic fixing portions 520, and the screw coupling portions 530, as an empty space.

The hollow portion 540 may be provided to reduce the weight of the frame 500 which may increase due to characteristics of the material of the frame 500 and the presence of the shelf holder 200.

The shelf holder 200 may be mounted in the holder receiver 510 formed in the frame 500, and in the same way as in the embodiment of the present disclosure, the track 100 may be mounted in the shelf holder 200 and the power supply 30 may be coupled, and the track connector 400 may be connected.

Accordingly, in a state where a hook of a shelf is coupled to the rod 210 of the shelf holder 200 and is held, electricity may be supplied to one side surface and the other side surface of the frame 500 simultaneously.

The frame 500 configured as described above may serve as an independent column unlike in the embodiment of the present disclosure.

Accordingly, in a certain space where a shelf is to be installed rather than being buried in a wall, the frame 500 including the shelf holder 200 and the track 100 mounted therein may be made to stand on a bottom and external power may be supplied through the power supply 300.

Thereafter, a certain rode 210 may be selected from the rods 210 of the shelf holder 200 and a shelf may be held thereon and mounted according to a purpose of displaying or exhibiting, and the track connector 400 connected to the shelf may be inserted into the shelf holder 200 and may be coupled to the track 100.

Through the above-described process according to the additional embodiment of the present disclosure, an electronic device such as lighting may be used even on a plurality of shelves installed on both ends of the frame 500 in an independent column shape.

The embodiments of the present disclosure described above are merely examples, and it will be understood by a person skilled in the art that various changes can be made therefrom and other equivalent embodiments are possible.

Therefore, it will be understood that the present disclosure is not limited to the form mentioned in the detailed descriptions. Therefore, the scope of the technical protection of the present disclosure should be defined by the technical concept of the appended claims.

In addition, it should be understood that the present disclosure includes the sprits of the present disclosure defined by the appended claims, and all variations, equivalents, and substitutes within the scope of the claims.

EXPLANATION OF SIGNS

10: shelf holding structure having attachable and detachable power supply
100: track
110: conductor
120: head
200: shelf holder
210: rod
220: track receiver
230: connector insertion portion
240: protrusion
300: power supply
310: power body
311: power head
**311*a***: power electrode
**311*b***: head recess
312: power tail
320: power cable
400: track connector
410: connector body
411: connector electrode
412: connector protrusion
420: shelf cable
500: frame
510: holder receiver
520: elastic fixing portion
530: screw coupling portion
540: hollow portion

What is claimed is:

1. A shelf holding structure having an attachable and detachable power supply, the shelf holding structure comprising:

a track formed in a ⊔-shape with an open upper portion;

a shelf holder comprising a track receiving space formed therein in a shape corresponding to the track, and having rods installed across an opened upper portion at predetermined intervals to hold a shelf;

a power supply inserted into one side surface or an opposite side surface of the track to supply external power; and a track connector inserted into a space between the rods of the shelf holder and mounted in the track to connect power to the shelf, wherein the track has a conductor disposed on an inner side surface thereof along a longitudinal direction, and is attachable to and detachable from an inside of the shelf holder, and the track further comprises heads formed on upper ends of both side surfaces to be bent inward by a predetermined length.

2. The shelf holding structure of claim 1, wherein the shelf holder further comprises:

a track receiver to allow the track to contact inner side surfaces and a lower surface thereof and to form a space to receive the track;

protrusions protruding from both side surfaces of the inside at a predetermined height along a longitudinal direction, and having a lower portion contact the heads formed on the upper ends of the track; and connector insertion portions formed between the rods to form a space through which the connector is inserted, wherein the track connector comprises: a connector body formed in a hexahedral shape having one end to be inserted and mounted in the track; and a shelf cable formed on another end of the connector body connect a current of the track to the shelf, and wherein the power supply comprises: a power body formed in a shape having one end to be received in the track and inserted into the track; and a power cable formed on another end of the power body to receive power.

3. The shelf holding structure of claim 2, wherein the connector body further comprises:

a connector electrode provided on a side surface contacting the track to come into contact with the conductor and to conduct electricity; and a plurality of connector protrusions formed in a shape to be engaged with the heads.

4. The shelf holding structure of claim 2, wherein the power body comprises:

a power head formed in a shape having one side thereof to be inserted and received in the track; and a power tail formed on another side of the power head larger than the power head to be supported in contact with an outer surface of the track, and wherein the power head further comprises:

a plurality of power electrodes formed on a side surface thereof contacting the conductor; and one pair of head recesses provided on both edges of an upper end in a recess shape corresponding to the heads formed on the upper ends of the track.

5. The shelf holding structure of claim 1, further comprising a frame formed in a hexahedral shape and comprising a plurality of holder receivers formed in a shape to receive the shelf holder, wherein the frame further comprises: an elastic fixing portion protruding from a portion to which an upper end of the shelf holder is coupled to support; a screw coupling portion coupled by a screw adjacent to the elastic fixing portion to fix the shelf holder; and a hollow portion formed on an inner surface as an empty space.

* * * * *